US005403218A

United States Patent [19]

Onoue et al.

[11] Patent Number: 5,403,218

[45] Date of Patent: Apr. 4, 1995

[54] SHIFTING MECHANISM FOR OUTBOARD DRIVE

[75] Inventors: Akihiro Onoue; Ryouji Nakahama, both of Hamamatsu, Japan

[73] Assignee: Sanshin Kogyo Kabushiki Kaisha, Shizuoka, Japan

[21] Appl. No.: 156,081

[22] Filed: Nov. 22, 1993

[30] Foreign Application Priority Data

Nov. 20, 1992 [JP] Japan ..... 4-335499

[51] Int. Cl.[6] ..... B63H 21/28

[52] U.S. Cl. ..... 440/75; 192/51; 192/48.91; 440/80; 440/88

[58] Field of Search ..... 440/75, 80, 81, 88, 440/83; 192/51, 48.91

[56] References Cited

U.S. PATENT DOCUMENTS

| | | | |
|---|---|---|---|
| 2,064,195 | 12/1936 | Michels | 440/81 X |
| 3,269,497 | 8/1966 | Bergstedt | 192/51 |
| 3,447,504 | 6/1969 | Shimanckas | 440/75 |
| 3,487,803 | 1/1970 | Alexander, Jr. | 440/75 |
| 3,492,966 | 2/1970 | Kiekhaefer | 440/75 |
| 4,343,612 | 8/1982 | Blanchard | 440/75 |
| 4,747,795 | 5/1988 | Kawamura et al. | 440/75 |
| 4,764,135 | 8/1988 | McCormick | 440/83 |
| 5,009,621 | 4/1991 | Bankstahl | 440/75 |

FOREIGN PATENT DOCUMENTS 60-259594 12/1985 Japan .

*Primary Examiner*—Sherman Basinger

*Attorney, Agent, or Firm*—Knobbe, Martens, Olson & Bear

[57] ABSTRACT

A shifting mechanism for an outboard drive of a watercraft provides a simple and compact transmission, as well as streamlines a lower unit of the outboard drive to reduce fluidic drag. The shifting mechanism is located on a drive train generally aligned along a vertical axis and above a propulsion shaft of the lower unit. The drive train includes a rotatable input shaft which is driven by a motor. The transmission of the shifting mechanism, which is located above a cavitation plate of the housing of the outboard drive, selectively couples the input shaft and a drive shaft. The drive shaft in turn is coupled to the propulsion shaft. The transmission includes a clutch which is slidably connected to the drive shaft to move along the vertical axis into and out of direct engagement with the input shaft.

30 Claims, 8 Drawing Sheets

SHIFTING MECHANISM FOR OUTBOARD DRIVE

BACKGROUND OF THE INVENTION

1. Field of the Invention

The present invention relates in general to a marine propulsion system, and more particularly to a shifting mechanism for an outboard drive.

2. Description of Related Art

Many forms of outboard drives employ forward, neutral, reverse transmissions. Such transmissions are common in both outboard motors and in the outboard drive units of inboard-outboard motors. These transmissions typically include a driving bevel gear and a pair of oppositely rotating driven bevel gears that are journaled within a lower unit of the outboard drive. A dog clutch mechanism selectively couples a propeller shaft to one of the driven bevel gears to rotate the propeller shaft in either a forward or a reverse direction, or to disconnect the propeller shaft from the driven gears in a neutral position. When the propulsion drive includes a second propeller, a second dog clutch selectively couples a second propeller shaft to one of the driven bevel gears. These gear sets, dog clutch mechanisms and associated shifting linkage are typically located in the lower unit of the outboard drive, below a water line of the watercraft. U.S. Pat. No. 4,793,773 to Kinouchin et al. discloses an example of this type of propulsion unit transmission.

In an effort to minimize the size of the lower unit and to provide a parabolically shaped lower unit, others have located the forward, neutral, reverse transmission on a vertical propulsion axle of the motor. U.S. Pat. No. 4,343,612, issued to Blanchard, discloses an example of an outboard unit with the transmission located on the propulsion axle of the motor. The outboard unit of Blanchard includes an input shaft and a drive shaft, which are positioned with portions of each juxtaposed. A plurality of meshed gears are used to couple the juxtaposed portions of the input shaft and the drive shaft together. An elaborate rim-type clutch is used to selectively couple the drive shaft to one of the gears driven by the input shaft. Although this shifting mechanism couples the drive and input shafts together, the numerous gears and complicated shifting mechanism significantly increase the size of the forward, neutral, reverse transmission, as well as increase the cost off the outboard drive.

SUMMARY OF THE INVENTION

In view of the foregoing drawbacks and shortcomings of the prior outboard units, a need exists for a compact and simply structured shifting mechanism for an outboard drive unit, which may be located above the water line of the watercraft.

In accordance with a preferred embodiment of the present invention, an outboard drive comprises a drive train generally aligned along a vertical axis and a lower unit having a propulsion shaft. The propulsion shaft is coupled to the drive train. The drive train includes a rotatable input shaft which is adapted to be driven by a motor. A rotatable drive shaft is positioned generally below the input shaft and a transmission selectively coupled the drive shaft to the input shaft. The transmission includes a clutch that is slidably connected to the drive shaft and is moved in a direction generally parallel to the vertical axis of the drive train.

In a preferred embodiment, the clutch of the transmission is an axial friction clutch which is positioned above a cavitation plate of the outboard drive and/or above the water level of the watercraft at planing speed. The outboard drive additionally includes a shift linkage which interconnects the clutch to a rotatable shift rod. The shift linkage converts rotational movement of the shift rod into linear movement of the clutch.

The outboard drive may also include a lubricant sump within an outer housing which houses the transmission of the drive train. The lubricant sump is desirably in fluidic communication with the transmission by influent and effluent conduits.

The transmission, which selectively couples the drive shaft to the input shaft, preferably includes a first gear connected to the input shaft and a second gear coupled to the first gear in a manner rotating the second gear in an opposite direction from that of the input shaft. The clutch of the transmission is interposed between the first gear and the second gear and is slidably connected to the drive shaft. The shift linkage moves the clutch between a first position, in which the clutch engages the first gear, and a second position, in which the clutch engages the second gear. The clutch desirably comprises a dual-sided clutch cone interposed between a pair of clutch cups. One cup is connected to the first gear and the other cup is connected to the second gear.

The drive shaft connects to the propulsion shaft by a second transmission. The second transmission preferably comprises a bevel gearset. The propulsion shaft desirably connects to a pair of propellers which it rotates in opposite directions from each other.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF A PREFERRED EMBODIMENT

Figure 1:
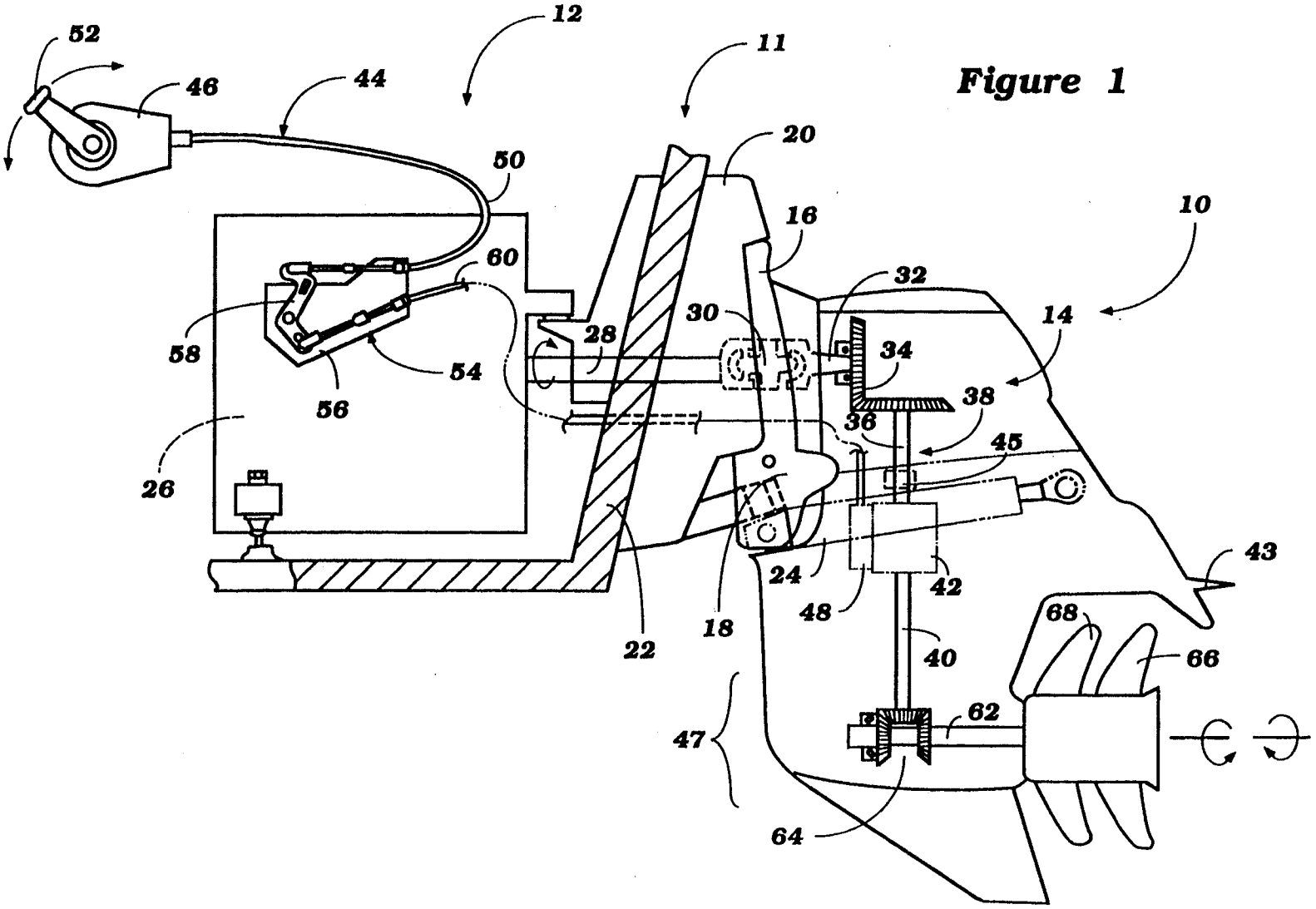
FIG. 1 is a schematic illustration of a marine outboard drive in accordance with a preferred embodiment of the present invention, as used with a conventional watercraft.

FIG. 1 illustrates a marine outboard drive 10 configured in accordance with a preferred embodiment of the present invention. In the illustrated embodiment, the outboard drive 10 is depicted as an outboard drive unit of an inboard-outboard drive. It is contemplated, however, that those skilled in the art will readily appreciate that the present invention can be applied to outboard motors as well (see FIG. 11).

For the purpose of describing the invention, a coordinate system is provided having mutually orthogonal coordinates oriented as follows: A "longitudinal" coordinate extending in a direction between a bow and a stern 11 of a watercraft 12 (see FIG. 1); a "lateral" coordinate extending in the direction between a port side and a starboard side of the watercraft 12 and intersecting the longitudinal coordinate at right angles; and a "vertical" component orthogonal to both the longitudinal coordinate and the lateral coordinate. Additionally, as used herein, "front" and "rear" are used in reference to the bow of the watercraft 12.

In the embodiment illustrated in FIG. 1, an outer housing 14 of the outboard drive 10 is connected to a gimbal housing 16, which houses a conventional gimbal ring 18. The gimbal ring 18 connects the outboard drive 10 to the watercraft 12 and allows the outboard drive 10 to rotate about the vertical axis, as well as to pivot about the lateral axis to tilt and trim the outboard drive 10, as known in the art. The gimbal ring 18 and housing 16 are attached to a stern plate 20, which in turn is mounted onto a transom 22 of the watercraft 12. A tilt and trim cylinder 24 extends between the outer housing 14 and the gimbal housing 16, and is attached in a known manner. The outboard drive 10 is tilted and trimmed, as well as rotated for steering purposes, by additional known mechanisms.

With reference to FIG. 1, a motor 26 (e.g., an internal combustion engine) powers the outboard drive 10. The motor 26 connects to an output shaft 28 that rotates in a constant direction. Although FIG. 1 illustrates the direction as clockwise, it is contemplated that the output shaft 28 may be rotated counterclockwise as well. The output shaft 28 extends from the motor 26 and passes through the transom 22 of the watercraft 12.

A universal joint 30, preferably a double Cardan joint, connects the output shaft 28 to a driven shaft 32 of the outboard drive 10. The driven shaft 32 connects to a bevel gearset 34, which transmits rotation between the driven shaft 32 and an intersecting input shaft 36 of a propulsion drive train 38. The bevel gearset 34 desirably has a pair of bevel gears made for a shaft angle of about 90°; however, it is contemplated that the driven shaft 32 and the input shaft 36 can intersect at almost any angle.

The propulsion drive train 38 is desirably aligned along the vertical axis. It should be appreciated, however, that the present outboard drive can have a propulsion drive train 38 skewed from the vertical axis as well. The propulsion drive train 38 includes a drive shaft 40 positioned below the input shaft 36. A first transmission 42 selectively couples the input shaft 36 to the drive shaft 40. The first transmission 42 advantageously is a forward, neutral, reverse-type transmission. In this manner, the input shaft 36 drives the drive shaft 40, which rotates either in a first direction or in a second counter direction, as described below in detail.

As seen in FIG. 1, the first transmission 42 is advantageously located above a cavitation plate 43 of the outer housing 14 and below a water pump 45 that is carried on the input shaft 36. The input shaft 36 always drives the water pump 45 in the same rotational direction and in a stabilized manner. Thus, in this arrangement, the function of the water pump 45 is not interrupted or otherwise impaired by gear shifting. Additionally, a lower unit 47 of the outer housing 14, located below the cavitation plate 43,, is streamlined by positioning the first transmission 42 above the cavitation plate 43. The streamline shape of the lower unit 47 reduces water resistance across the lower unit to improve performance characteristics of the outboard drive 10.

A shifting mechanism 44 controls the first transmission 42. The shifting mechanism 44 includes a gear Shifter 46 coupled to a shift linkage 48 via a bowden wire cable 50. The gear shifter 46 is mounted conventionally, proximate to the steering controls (not shown) of the watercraft 12 and includes a shift lever 52. The bowden wire cable 50 desirably extends from the gear shifter 46 to a lever mechanism 54, which is conventionally mounted on the motor housing. The lever mechanism 54 includes a base 56 and a rocker lever 58 that rotates in response to movement of the shift lever 52. An opposite end of the rocker lever 58 couples to the shift linkage 48 (see FIG. 2) via a second bowden wire cable 60 so as to move the shift linkage 48 in response to movement of the shift lever 52, as known in the art. The shift linkage, in response, controls the first transmission, as discussed below.

The drive shaft 40 of the propulsion drive train 38 is coupled to a propulsion shaft 62 via a second transmission 64. The second transmission 64, as explained in detail below, includes a bevel gear train that transmits rotation of the drive shaft 40 to the propulsion shaft 62. The propulsion shaft 62, in turn, drives a propulsion device, such as, for example, a propeller, a hydrodynamic jet, or the like. In the illustrated embodiment, the propulsion device is a counter-rotational propeller device that includes a first propeller 66 designed to spin in one direction and to assert a forward thrust, and a second propeller 68 designed to spin in the opposite direction and to assert a forward thrust. The counter-rotational propeller device will be explained in detail below.

The individual components of the marine outboard drive 10 will now be described in detail with reference to FIGS. 2–10.

Figure 2:
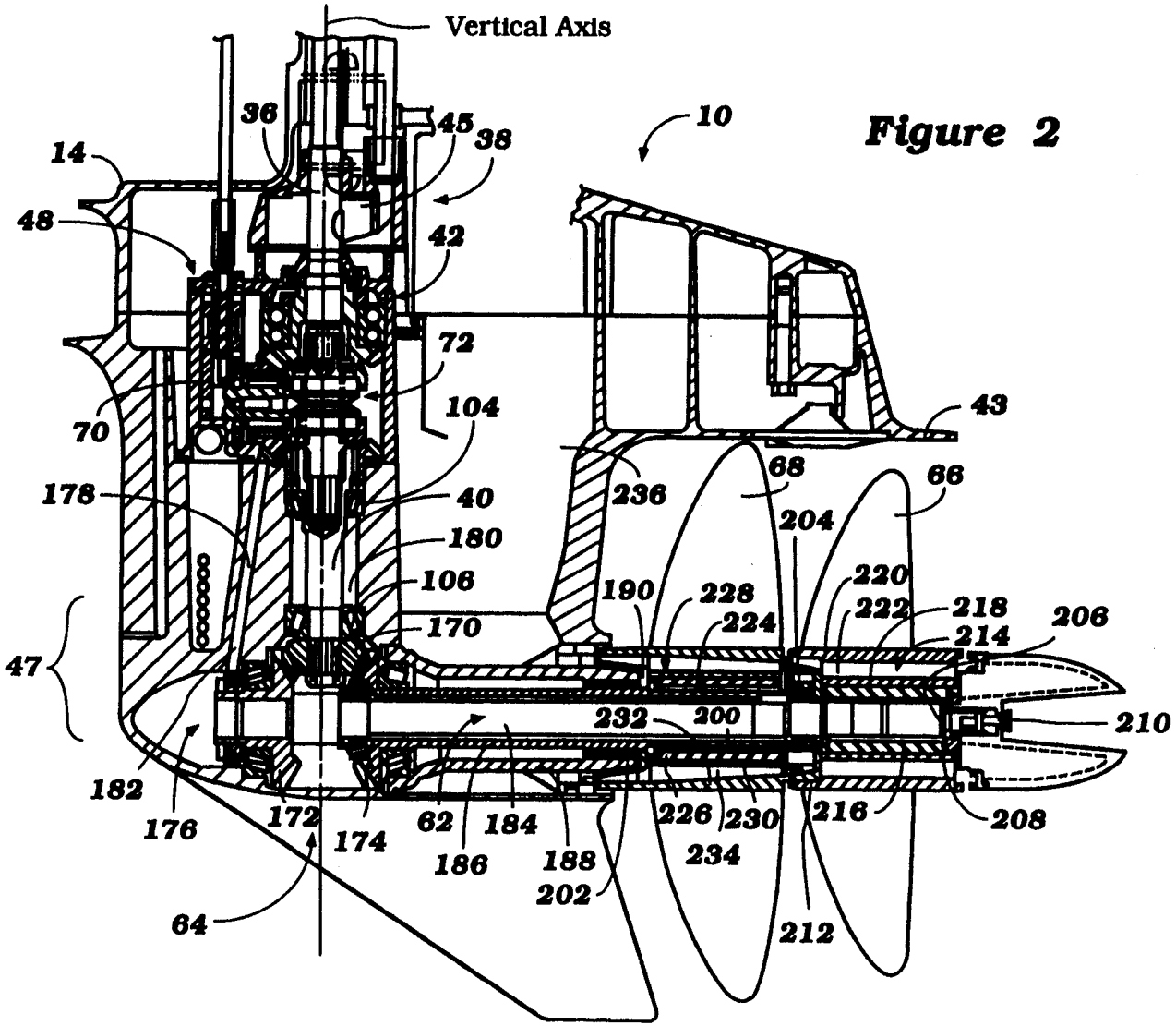
FIG. 2 is a sectional elevational view of the marine outboard drive in accordance with the preferred embodiment that FIG. 1 schematically illustrated.

FIG. 2 illustrates the vertically oriented input shaft 36 of the propulsion drive train 38. The input shaft 36 extends downwardly from the upper bevel gearset 34 (shown in FIG. 1). As seen in FIG. 2, the input shaft 36 is suitably journaled within the outer housing 14 of the outboard drive 10.

The outer housing 14 defines a cavity which receives a removable transmission housing 70. The transmission housing 70 houses the first transmission 42 and the shift linkage 48.

Figure 3:
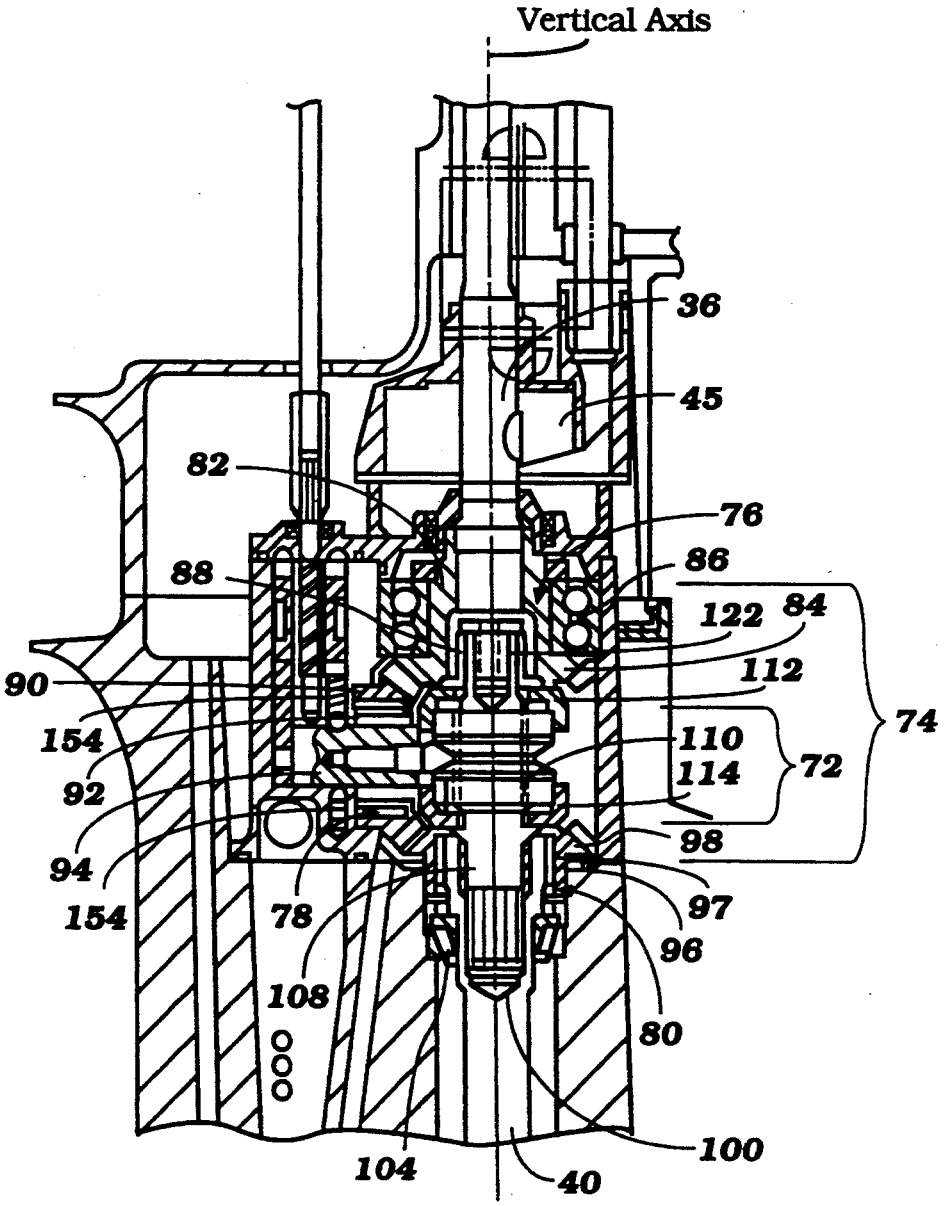
FIG. 3 is an enlarged sectional elevational view of a first transmission of the outboard drive of FIG. 2.

With reference to FIG. 3, the first transmission 42, which is used to selectively couple the input shaft 36 with the drive shaft 40, principally comprises a cone clutch assembly 72 and a bevel gear train 74. The bevel gear train 74 is formed by a first gear assembly 76, a transfer gear assembly 78, and a second gear assembly 80.

The first gear assembly 76 includes a first bevel gear hub 82 having a spline connection with the input shaft 36 and a first bevel gear 84. A double-row ball bearing 86 supports the bevel gear hub 82. It should be understood, however, that other types of bearings, such as, for example, roller or thrust bearings, could be used as well to journal the first gear assembly 76 within the outer housing 14 of the outboard drive 10. The first bevel gear hub 82, at its lower end defines a cavity which fixedly receives a bushing 88. The bushing 88 is desirably positioned concentrically about the vertical axis (i.e., the axis of the input shaft 36).

The transfer gear assembly 78 includes a transfer gear 90 positioned at about a 90° shaft angle with the first bevel gear 84. A bearing 92 (e.g., ball bearing) journals the transfer bevel gear 90 within the outer housing 14 and about a cylindrical can-member 94 of the shift linkage 48, which will be described in detail below.

The second gear assembly 80 includes a second bevel gear hub 96, which is journaled on the exterior of the drive shaft 40 by means of a bearing 97 (e.g., a needle bearing). The second gear assembly 80 is also suitably journaled within the outer housing 14.

The bevel gear hub 96 includes a second bevel gear 98 at its upper end. The bevel gear 98 meshes with the transfer bevel gear 90 at a pinch point substantially opposite that at which the first bevel gear 84 meshes with the transfer bevel gear 90.

The drive shaft 40, at its upper end, defines a splined bore 100 that receives a portion of a clutch assembly 72, as explained below. The drive shaft 40 depends into the lower unit 47 (FIG. 2). As seen in FIG. 2, the drive shaft 40 is journaled by means of a first thrust bearing 104 that is positioned proximate to the transmission housing 70, and a lower thrust bearing 106 that is positioned proximate to the second transmission 64 of the lower unit 47.

With reference to FIG. 3, the clutch assembly 72 of the first transmission 42 selectively couples the input shaft 36 and drive shaft 40 together. The clutch assembly 72 is advantageously a friction-type clutch to reduce coupling shock by slipping slightly during the engagement period. It is appreciated, however, that the present outboard drive could be designed with a positive clutch as well. It is also preferred that the clutch assembly be an axial-type clutch, which is generally aligned along the vertical axis.

In the illustrated embodiment of FIG. 3, the clutch assembly 72 comprises a clutch shaft 108 over which a dualsided clutch cone 110 rides. The cone clutch assembly 72 also includes a pair of opposing cups 112, 114, which are configured to matingly receive a correspondingly shaped end of the clutch cone 110. The first cup 112 is affixed to the first bevel gear 84. Likewise, the second cup 114 is affixed to the second bevel gear 98. When assembled, the clutch cone 110 can be moved from a position engaging the first cup 112 to a second position engaging the second cup 114 of the clutch assembly 72. FIG. 3 illustrates the clutch cone 110 positioned between the first cup 112 and the second cup 114, in a neutral position.

Figure 4:
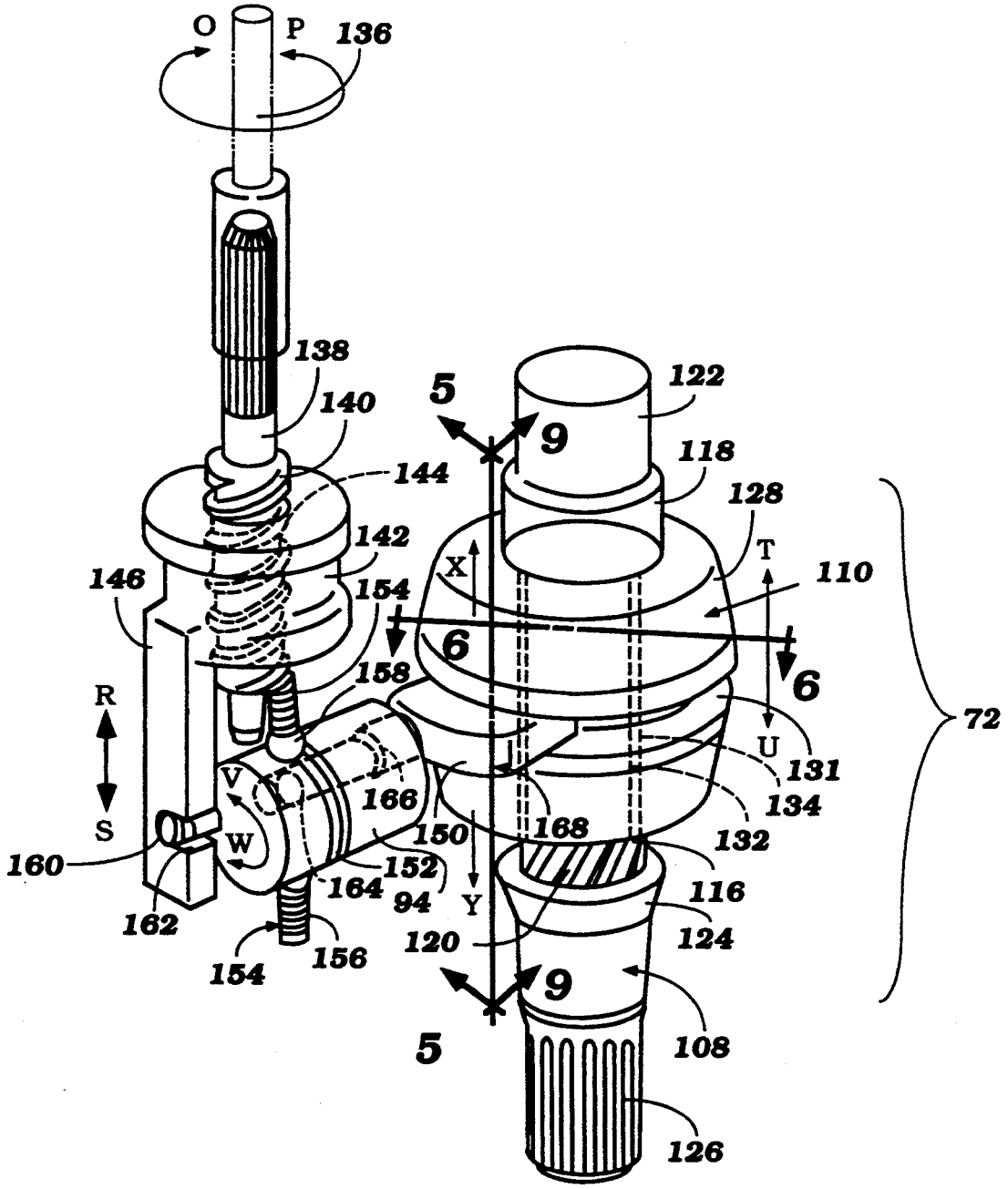
FIG. 4 is a perspective view of a clutch assembly and a shift linkage of the marine outboard drive of FIG. 2.

With reference to FIG. 4, the clutch shaft 108 is formed by an intermediate shaft portion 116 flanked at its upper end by a hub 118. The intermediate shaft portion 116 carries helical spline teeth 120.

The hub 118 includes a cylindrical bearing surface 122 that, as best seen in FIG. 3, is piloted and journaled with the bushing 88 of the first gear assembly 76. The clutch shaft 108 has a spline connection (not shown) at its upper end with the hub 118, which is attached once the clutch cone 110 is positioned on the intermediate shaft portion 116 of the clutch shaft 108. In this manner, the clutch cone 110 is interposed between the hub 118 and the annular flange 124 of the clutch shaft 108.

With reference back to FIG. 4, a lower end off the shaft portion 116 terminates in an annular flange 124. The annular flange 124 transitions into a spline connection 126 which engages the splined bore 100 of the drive shaft 40.

Figure 5:
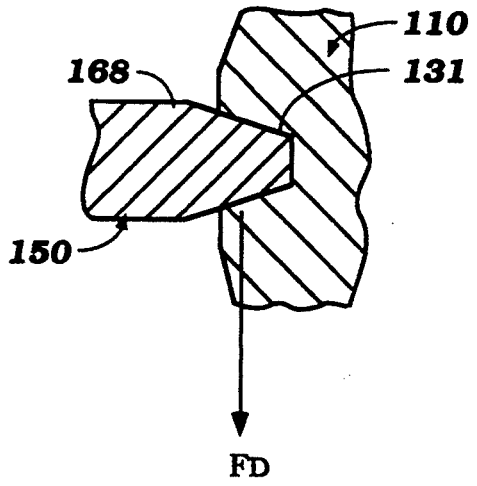
FIG. 5 is a partial cross-sectional elevational view taken along line 5—5 of FIG. 4.

As best seen in FIG. 4, the dual-sided clutch cone 110 has a generally spool-like configuration formed by an upper cone portion 128 and a lower cone portion 130. Each cone portion 128, 130 generally has a truncated conical shape, tapering in diameter toward its end. It is contemplated, however, that the clutch could be configured in a variety of styles adapted to suit specific applications. The clutch cone 110 also includes an annular groove 131 that circumscribes a midsection of the clutch cone 110 between the cone portions 128, 130. As best seen in FIG. 5, the annular groove 131 has a generally truncated "V"-shaped cross section.

With reference to FIG. 4, the clutch cone 110 has a length in a vertical direction less than the length of the intermediate shaft portion 116 of the clutch shaft 108, which allows the clutch cone 110 to be moved from a position engaging the first cup 112 of the cone clutch assembly 72 to a position engaging the second cup 114 of the cone clutch assembly 72.

Figure 6:
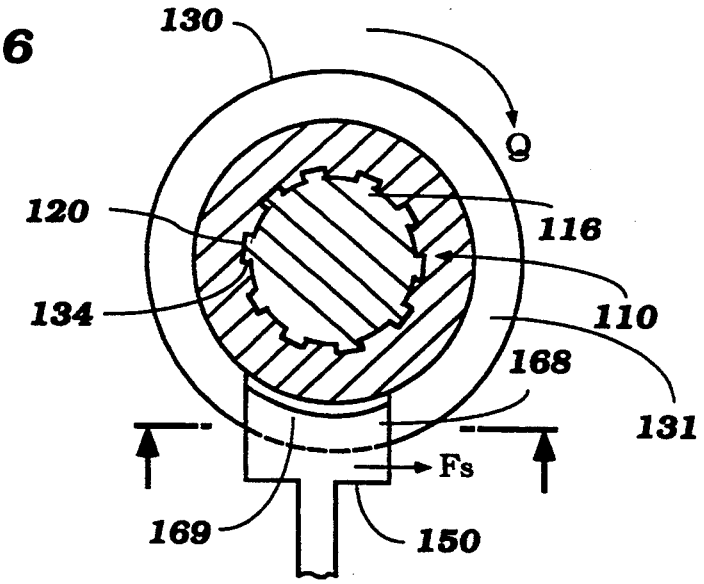
FIG. 6 is a cross-sectional top plan view taken along line 6—6 of FIG. 4.

The clutch cone 110 includes an axial bore 132 that extends between the ends of the cone portions 128, 130. The axial bore 132 is sized to receive the intermediate shaft portion 116 of the clutch shaft 108. As seen in FIGS. 3 and 6, the axial bore includes helical spline grooves 134 that engage the helical spline teeth 120 of the intermediate shaft portion 116. The helical spline engagement between the clutch shaft 116 and the clutch cone 110 prevents the clutch cone 110 from rotating about the clutch shaft 116, as well as increases the engagement force between the cone portion 128, 130 and the corresponding cup 112, 114, respectively, as discussed in detail below. For this purpose, the windings of the helical teeth 120 and grooves 134 are preferably in the direction of rotation of the input shaft 36 as viewed in the upward direction.

As noted above, the shift linkage 48 moves the clutch cone 110 from a position engaging the first cup 112, through a neutral position, and to a position engaging the second cup 114. FIGS. 3 and 4 best illustrate an exemplary embodiment of the shift linkage 48.

The shift linkage 48 connects the clutch cone 110 to a first shift rod 136, which in turn is coupled to and controlled by the gear shifter 46, by known means. The shift linkage 48 desirably converts rotational movement of the first shift rod 136 into linear movement of the clutch cone 110 to move the clutch cone 110 generally along the vertical axis between the cups 112, 114 of the cone clutch assembly 72.

With reference to FIG. 4, the shift linkage 48 includes a second shift rod 138 having at one end a spline connection with the first shift rod 136 and having at its other end a worm 140. An annular worm gear 142 meshes with the worm 140 to move in the vertical direction in response to rotation of the worm 142. The annular worm gear 142 has a generally cylindrical shape with a threaded bore 144. The axial pitch of the gear threads of the bore 144 substantially match that of the worm 140.

An arm 146 depends from a lower portion of the annular worm gear 142 and has a generally rectangular parallelepiped shape. The arm 146 rides in a correspondingly shaped groove (not shown) defined by the transmission housing 70 to prevent the annular worm gear 142 from rotating with the worm 140.

The cam member 94 interconnects the arm 146 of the annular worm gear 142 with a clutch fork 150 coupled to the clutch cone 110. The cam member 94 has a cylindrical shape with an annular groove 152 circumscribing its midsection. The groove 152 has an arcuately shaped cross section with a substantially uniform radius of curvature.

A pair of diametrically opposed screw elements 154 support the cam member 94. Each screw element 154 has a threaded shaft 156, which, as seen in FIG. 3, engages a correspondingly threaded hole formed in the housing 70 of the first transmission 42. With reference to FIG. 4, each screw 154 also includes a spherical head 158, a portion of which contacts the annular groove 152 of the cam member 94. The radius of curvature of the spherical head 158 of each screw 154 substantially matches that of the radius of curvature of the arcuately shaped annular groove 152. In this manner, the cam member 94 can rotate when interposed between and supported by the screw members 154.

The cam member 94 includes an eccentrically positioned pin 160 that extends from one end of the cam member 142. The pin 160 is inserted into a notch 162 formed in the arm 146 to couple the cam member 94 to the arm 146.

The cam member 94 also includes a bore 164 that extends into the cam member 94 from an end opposite that on which the pin 160 is located. The bore 164 is configured to receive, fin a slip-fit manner, a shaft 166 of the clutch fork 150 to interconnect the clutch fork 150 and the cam member 94. The axis of the bore 164 is desirably coaxially aligned with the axis of the pin 160, and is thus eccentric relative to the axis of the cam member 94.

As seen in FIG. 4, the clutch fork 150 has a head 168 that slidably engages a portion of the annular groove 131 of the clutch cone 110. With reference to FIG. 5, the clutch fork head 168 desirably has a cross-sectional shape that substantially matches the cross-sectional shape of the annular groove 131. A portion of the clutch fork head 168 inserts into the groove 131 in a slip-fit fashion and is able to slide within the groove 131, as discussed below.

As illustrated in FIG. 6, the clutch fork head 168 desirably has an arcuately shaped edge 169. Some clearance exists between the edge 169 of the clutch fork head 168 and the curved bottom surface of the groove 131 Of the clutch cone 110 to permit the clutch fork 150 to move slightly within the groove 131 in the lateral direction. Of course, it is also understood that the clutch fork head 168 could have a straight edge 169 as well.

With reference to FIG. 4, the shaft 166 of the clutch fork 150 extends from the clutch fork head 168 away from the clutch cone 110, and inserts into the bore 164 of the cam member 94. Both the bore 164 and the clutch fork shaft 166 desirably have tapering diameters. The shaft 166 of the clutch fork 150 is desirably sized slightly smaller than the bore 164 of the cam member 94 so as to be slip-fit therein. In this manner, the clutch shaft 166 can rotate within the bore 164 as the cam member 94 rotates, to maintain the clutch fork head 150 within the groove 131 of the clutch cone 110.

With reference to FIG. 2, the drive shaft 40 depends from the first transmission 42 to the lower unit 47. The drive shaft 40 carries a drive bevel gear 170 at its lower end, which is disposed within the lower unit 47 of the housing 14 and which forms a portion of the second transmission 64.

Figure 7:
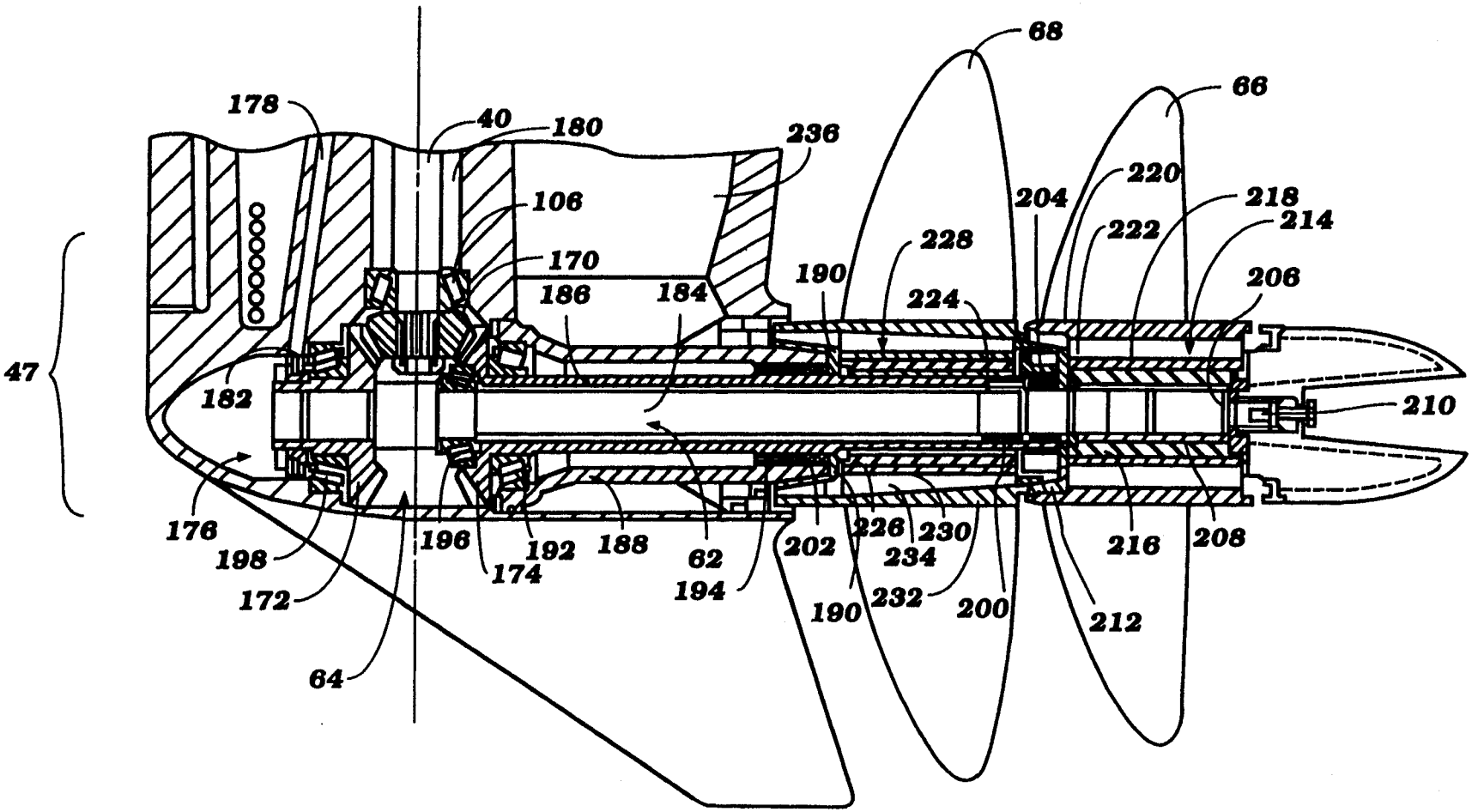
FIG. 7 is an enlarged sectional elevational view of a lower unit of the outboard drive of FIG. 2.

With reference to FIG. 7, the second transmission 64 includes a pair of counter-rotating driven bevel gears 172, 174 that are in mesh engagement with the drive bevel gear 170 attached to the lower end of the drive shaft 40. The pair of driven bevel gears 172, 174 are positioned on diametrically opposite sides of the drive bevel gear 170, and are suitably journaled within the lower unit 47, as described below.

The second transmission 64 is contained within a cavity 176 of the lower unit 47, which, in effect, defines a lubricant reservoir or lubricant sump. As best seen in FIG. 2, an effluent conduit 178 is formed in the outer housing 14 and extends between the lubricant sump 176 and the housing 70 of the first transmission 42. An influent conduit 180 is also formed in the outer housing 14 and extends between the housing 70 of the first transmission 42 and the lubricant sump 176. In the illustrated embodiment, the influent conduit 180 is a bore formed in the outer housing 14 through which the drive shaft 40 extends from the first transmission 42 to the second transmission 64; however, it is contemplated that the influent conduit 180 could be formed independently of the bore as well.

With reference to FIGS. 2 and 7, rotation of the bevel gearset 170, 172, 174 of the second transmission 64 pressurizes the fluid in the lubricant sump 176 proximate to a port 182 of the effluent conduit 178. The pressurized lubricant flows through the effluent conduit 178 and discharges into the housing 70 of the first transmission 42 to lubricate and cool the bevel gearset 76, 78, 80 and[the clutch assembly 72 of the first transmission 42. The rotation of the bevel gearset 76, 78, 80 of the first transmission 42 assists in drawing the lubricant through the effluent conduit 178, as well as distributing the lubricant within the first transmission 42, as known in the art. The lubricant drains from the first transmission 42 through the influent conduit 180 and into the lubrication sump 176. In so doing, the lubricant flows through the thrust bearings 104, 106, which journal the drive shaft 40 in the outer housing 14, as well as through the bevel gearset 170, 172, 174 of the second transmission 64.

Heat from the heated lubricant, which has returned to the lubrication sump 176, is dissipated through the wall of the lower unit 47 to the surrounding water. In this manner, the lubricant effectively lubricates, as well as cools, the first transmission 42, the second transmission 64, and the drive shaft 40. The lubricant also lubricates and cools the propulsion shaft 62, as discussed below.

As noted above, the second transmission 64 transmits motion from the vertical drive train 38 to a propulsion shaft 62 that drives a propulsion device. In the illustrated embodiment, the propulsion device comprises a counter-rotating propeller device. The illustrated outboard drive 10 is particularly suited for use with a counter-rotating propeller device because the two driven bevel gears 172, 174 of the second transmission 64 drive the propellers 66, 68, rather than form part of a conventional forward, neutral, reverse transmission. It is understood, however, that the present outboard drive 10 could likewise be applied with other types of propulsion devices, such as, for example, hydrodynamic jets or single-propeller drives, as well.

With reference to FIG. 7, the propulsion shaft 62 advantageously includes an inner shaft 184 and a hollow outer shaft 186 that drive the first propeller 66 and the second propeller 68, respectively. The inner shaft 184 drives the first propeller 66 in the same direction as the output shaft 28 (FIG. 1) of the motor 26. The first propeller 66 is adapted to exert a forward drive thrust when rotated in this direction. The outer propulsion shaft 186 drives the second propeller 68 in a direction opposite the rotation of the motor output shaft 28. The second propeller 68 is adapted to exert a forward drive thrust when rotated in this direction. The blades of the second propeller 68 are desirably slightly larger than those of the first propeller 66, as known in the art.

The lower unit 47 includes a bearing casing 188. The bearing casing 188 rotatably supports the outer propulsion shaft, as discussed below. A front end ring 190, attached to the outer housing 14, secures the bearing casing 188 to the outer housing 14.

The outer propulsion shaft 186, at an end opposite that on which the second propeller 68 is mounted, carries the driven rear bevel gear 174 of the second transmission 64. A thrust bearing 192 journals the outer propulsion shaft 186 within the bearing casing 188 to support the rear bevel gear 174 in mesh engagement with the drive bevel gear 170 attached to the lower end of the drive shaft 40. A needle bearing 194 supports the outer propulsion shaft 186 within the bearing casing 188 at an opposite end of the bearing casing 188 from the thrust bearing 192.

The inner propulsion shaft 184 carries the driven front bevel gear 172 at an end opposite that at which the first propeller 66 is mounted. The inner shaft 184 extends through the outer shaft 186 and is suitably journaled therein. Specifically, a rearward thrust bearing 196, connected to the rear bevel gear 174 carried by the outer propulsion shaft 186, supports a portion of the inner propulsion shaft 184. A front thrust bearing 198 journals the front bevel gear 172. A needle bearing 200 supports the inner shaft 184 at the rear end of the outer shaft 186.

A first pair of seals 202 (e.g., oil seals) is interposed between the bearing casing 188 and outer propulsion shaft 186 at the rear end of the bearing casing 188. Likewise, a second pair of seals 204 (e.g., oil seals) is interposed between the inner shaft 184 and the outer shaft 186 at the rear end of the outer shaft 186. Lubricant within the lubricant sump 176 flows through the gaps between the bearing casing 188 and the outer shaft 186, and between the outer shaft 186 and the inner shaft 184 to lubricate the bearings 192, 194, 200 supporting the inner propulsion shaft 184 and the outer propulsion shaft 186. The seals 202, 204 located at the rear ends of the bearing casing 188 and of the outer shaft 186 substantially prevent lubricant flow beyond these points.

The inner shaft 184, on the rear side of the rear end of the outer shaft 186, tapers in diameter towards its rear end 206. The rear end 206 of the inner shaft 184 has a smaller diameter than the portion of the inner shaft 184 supported within the outer shaft 186.

The tapered rear end 206 of the inner shaft 184 carries an engagement sleeve 208 having a spline connection with the tapered rear end 206 of the inner shaft 184. The sleeve 208 is fixed to the inner shaft rear end 206 between a nut 210 threaded on the rear end 206 of the shaft 184 and an annular retainer ring 212 that engages the tapered section of the inner shaft 184 proximate to the rear end of the outer shaft 186.

The inner shaft 184 also carries a first propeller boss 214. An elastic bushing 216 is interposed between the engagement sleeve 208 and the propeller boss 214 and is compressed therebetween. The bushing 216 is secured to the engagement shaft 208 by a heat process known in the art. The frictional engagement between the boss 214, the elastic bushing 216, and the engagement sleeve 208 is desirably sufficient to transmit rotational forces from the sleeve 208 to the propeller 66 attached to the propeller boss 214.

The propeller boss 214 has an inner sleeve 218 and an outer sleeve 220 to which the propeller blades 68 are integrally formed. A plurality of radial ribs 222 extend between the inner sleeve 218 and the outer sleeve 220 to support the outer sleeve 220 about the inner sleeve 218 and to form passages through the propeller boss 214. Engine exhaust is exhausted through these passages in the propeller boss 214, as known in the art and as described below.

The outer shaft 186 carries the second propeller 68 in a similar fashion. As best seen in FIG. 7, the rear end portion of the outer shaft 186 carries a second engagement sleeve 224 in driving engagement thereabout by a spline connection. The second engagement sleeve 224 is captured onto the shaft 186 between the annular retaining ring 212 and the front end ring 190

A second annular elastic bushing 226 surrounds the second engagement sleeve 224. The bushing 226 is secured to the sleeve 224 by heat process known in the art.

A second propeller boss 228 surrounds the elastic bushing 226, which is held under pressure between the boss 228 and the sleeve 224 in frictional engagement. The frictional engagement between the propeller boss 228 and the bushing 226 is sufficient to transmit a rotational force from the sleeve 224 to the second propeller 68 attached to the second propeller boss 228.

Similar to the first propeller boss 214, the second propeller boss 228 has an inner sleeve 230 and an outer sleeve 232. The propeller blades of the second propeller 68 are integrally formed on the exterior of the outer sleeve 232. Ribs 234 interconnect the inner sleeve 230 and the outer sleeve 232 and form axially extending passages between the sleeves 230,232 that communicate with an exhaust passage 236 in the outer housing 14 and with the passages of the first propeller boss 214, as conventionally known.

The following elaborates on the previous description of the function of the present outboard drive 10 with reference to FIGS. 3, 4 and 7. To engage the clutch 110 with the input shaft 36, the shift lever 52 is moved from a neutral position to a forward position. The first shift rod 136 and the second shift rod 138 both rotate clockwise in response (i.e., in the 0 direction, as illustrated in FIG. 4). The annular worm gear 142 moves upwardly (in the R direction) as the worm 40 rotates in the clockwise direction. The upward movement of the annular worm gear 140 moves the arm 146 upwardly (in the R direction). This upward movement is transferred to the pin 160, which slides in the notch 162 of the arm 146 and causes the cam member 94 to rotate (in the W direction). Rotation of the cam member 94 moves the clutch fork 150 upwardly (in the X direction). The eccentric position of the clutch fork relative to the cam member 94 also produces lateral movement of the clutch fork 150, which slides in the annular groove 131 of the clutch cone 110.

The shift linkage 48 moves the clutch cone 110 upwardly (in the T direction), together with the clutch fork 150. As a result, the clutch cone portion 128 moves into the cup 112, fixed to the bevel gear 84, and engages the clutch cup 112 to produce a frictional force between the two surfaces. This frictional force is sufficient to transmit rotation of the input shaft 36 to the clutch assembly 72.

Because the clutch cone 110 is provided with a spline groove 134 for engaging the helical spline teeth 120 of the clutch shaft portion 116, the clutch cone 110 is free to move up and down along the axis of the clutch shaft 108 while its rotational movement is restrained. That is, the spline engagement between the clutch cone 110 and the clutch shaft portion 116 prevents the clutch cone from rotating about the clutch shaft 108 when the clutch cone 110 engages the clutch cup 112. As a result, the clutch cone 110 and the clutch shaft 108 rotate together in the same direction. The clutch cone 110 does rotate slightly as it follows the behind spline teeth 120 of the clutch shaft 108 when moved linearly over the clutch shaft 108.

The clutch cone 110 engages the first cup 112 of the cone clutch assembly 72 to couple the input shaft 36 with the drive shaft 40. The frictional force produced by the engagement between the clutch cone portion 128 and the cup 112 is sufficient to transmit rotational motion of the input shaft 36 to the clutch shaft 108 with minimal slip. The clutch shaft 108, by its spline connection with the drive shaft 40, directly transmits the rotation of the input shaft 36 to the drive shaft 40. Thus, the drive shaft 40 and the input shaft 36 rotate together in the same direction about the vertical axis.

The drive shaft 40, in turn, drives the drive bevel gear 170 of the second transmission 64. Rotation of the drive bevel gear 170 is transmitted to the driven front bevel gear 172 to rotate the first propeller 66 in the same rotational direction as that of the motor output shaft 28 (FIG. 1). The drive bevel gear 170 also transmits rotation to the driven rear bevel gear 174, which rotates in a direction opposite from that of the front bevel gear 172. In this manner, the outer drive shaft 186 rotates the second propeller 68 in a rotational direction opposite that of the first propeller 66.

To disengage the clutch cone 110 and to move the clutch cone 110 to a neutral position or to a position of opposite rotation, the shift lever 52 is moved from the forward position to the reverse position. This movement causes the first shift rod 136 and the second shift rod 138 to rotate in a counterclockwise direction (i.e., in the P direction). This rotation is transmitted to the cam member 94 and the clutch fork 150, as discussed above.

Figure 8:
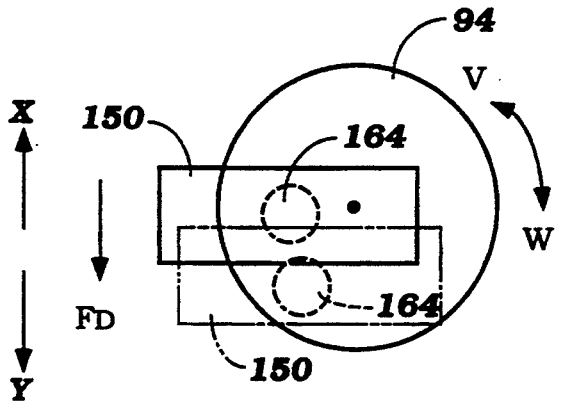
FIG. 8 is an elevational view of a cam member and clutch fork assembly of the shift linkage of FIG. 4.
Figure 9:
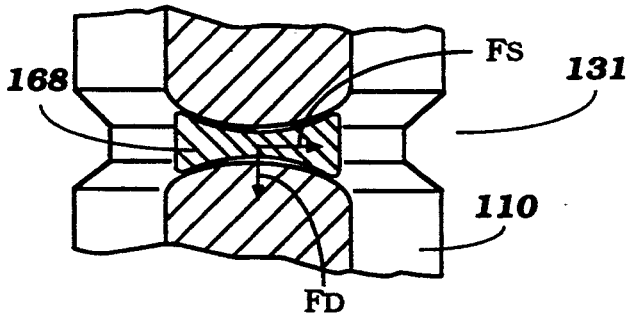
FIG. 9 is a partial cross-sectional elevational view taken along line 9—9 of FIG. 4.

As illustrated in FIG. 8, the clutch fork rotates in the V direction around the center of the cam member 94 to move the clutch fork in a downward direction (i.e., in the Y direction of FIG. 4). The downward movement of the clutch fork 150 moves the clutch cone 110 out of engagement with the cup 112 and to a neutral position between the clutch cups 112, 114. Further downward movement (i.e., clutch cone movement in the U direction of FIG. 4) causes the clutch cone 110 to engage the second clutch cup 114.

When engaged, the clutch cone portion 130 contacts the clutch cup 114 to produce a friction force between the two surfaces. This friction force is sufficient to transmit rotation of the second clutch cup 114 to the clutch cone 110 such that the clutch shaft 108 rotates in a direction opposite of that of the input shaft 36.

Figure 10:
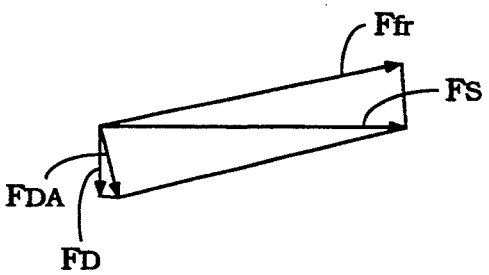
FIG. 10 is a vector force diagram illustrating the forces which act on a clutch cone of the clutch assembly of FIG. 4.

With reference to FIGS. 6, 8, and 10, the helical spline engagement between the clutch shaft 108 and the clutch cone 110 increases the frictional force between the surfaces of the clutch cone portion 130 and the clutch cup 114. As noted above, this helical spline engagement also increases the friction force between the surfaces of the clutch cone upper portion 128 and the upper clutch cup 112. Thus, it should be understood that the following explanation of the helical spline engagement in connection with the lower clutch cone portion 130 and the lower clutch cup 114 also explains the benefit of the helical spline engagement in connection with the upper clutch cup portion 128 and the upper clutch cup 112.

The engagement between the lower clutch cup 114 and the clutch cone lower portion 130 produces a rotational force $F_s$ on the clutch cone portion 130 in the direction of rotation of the lower clutch cup 114 (i.e., in the Q direction of FIG. 6). This rotational force $F_s$ acts against the helical threads of the clutch shaft 108 which prevent the clutch cone 110 from rotating about the clutch shaft 108.

As diagramed in FIG. 10, because the helical spline teeth 120 are wound in the downward direction in a direction of rotation, the rotational force $F_s$, acting against the teeth, can be resolved into a frictional force $F_f$, and a downward force $F_{DA}$. The downward force $F_{DA}$ is combined with the force $F_D$ produced by rotation of the cam member 94 in the V direction to force the clutch cone portion 130 against the clutch cup 114.

These forces $F_D$, $F_{DA}$, which act generally normal to the contact surfaces between the clutch cone portion 130 and the clutch cup 114, produce a sufficient friction force to cause the clutch cone 110 and clutch cup 114 to rotate together. The additional downward force $F_{DA}$, produced by the rotational force $F_s$ acting on the helical splines 120, thus increases the frictional connection between the clutch cone 110 and the clutch cup 114.

It should be noted that because the upper clutch cup 112 rotates in an opposite direction to that of the lower clutch cup 114, the windings of the helical splines in the upward direction are also in the rotational direction of the upper clutch cup 112. Similar to the discussion above, the resultant rotational force applied to the clutch cone 110, acts against the helical threads to produce an upward force component which drives the clutch cone 110 against the upper clutch cup 112.

With reference back to FIG. 2, the second bevel gear 98 of the first transmission 42 rotates in a direction opposite to that of the input shaft 36. The clutch shaft 108 and the drive shaft 40 consequently also rotate in a direction opposite to that of the input shaft 36 when the clutch cone 110 engages the second clutch cup 114. The drive shaft 40, in turn, drives the drive bevel gear 170 of the second transmission 64. Rotation of the drive bevel gear 170 is transmitted to the driven front bevel gear 172 to rotate the first propeller 66 in a rotational direction opposite to that of the motor output shaft 28 (FIG. 1). The drive bevel gear 170 also transmits rotation to the driven rear bevel gear 174, which in turn rotates in a direction opposite from that of the front bevel gear 172. In this manner, the outer drive shaft 186 rotates the second propeller 68 in a rotational direction opposite of that of the first propeller 66.

In the illustrated embodiment, when the clutch cone 110 engages the second clutch cup 114, the first propeller 66 and the second propeller 68 exert a rearward drive thrust. However, it is understood that the rotational direction of the first bevel gear 84 and the second bevel gear 98 of the first transmission 42 can be reversed so as to produce an opposite drive thrust arrangement.

At planing speed, the watercraft 12 planes over the water, with the water rising over the hull of the watercraft 12 to a particular water level. The present outboard drive 10 desirably positions the first transmission 42 above this water line to reduce the size of the lower unit 47 in the water at planing speed and thus to reduce fluidic drag or resistance. The position of the first transmission 42, as noted above, also does not interfere with the performance of the water pump 45, which is conventionally positioned on the input shaft 36.

Figure 11:
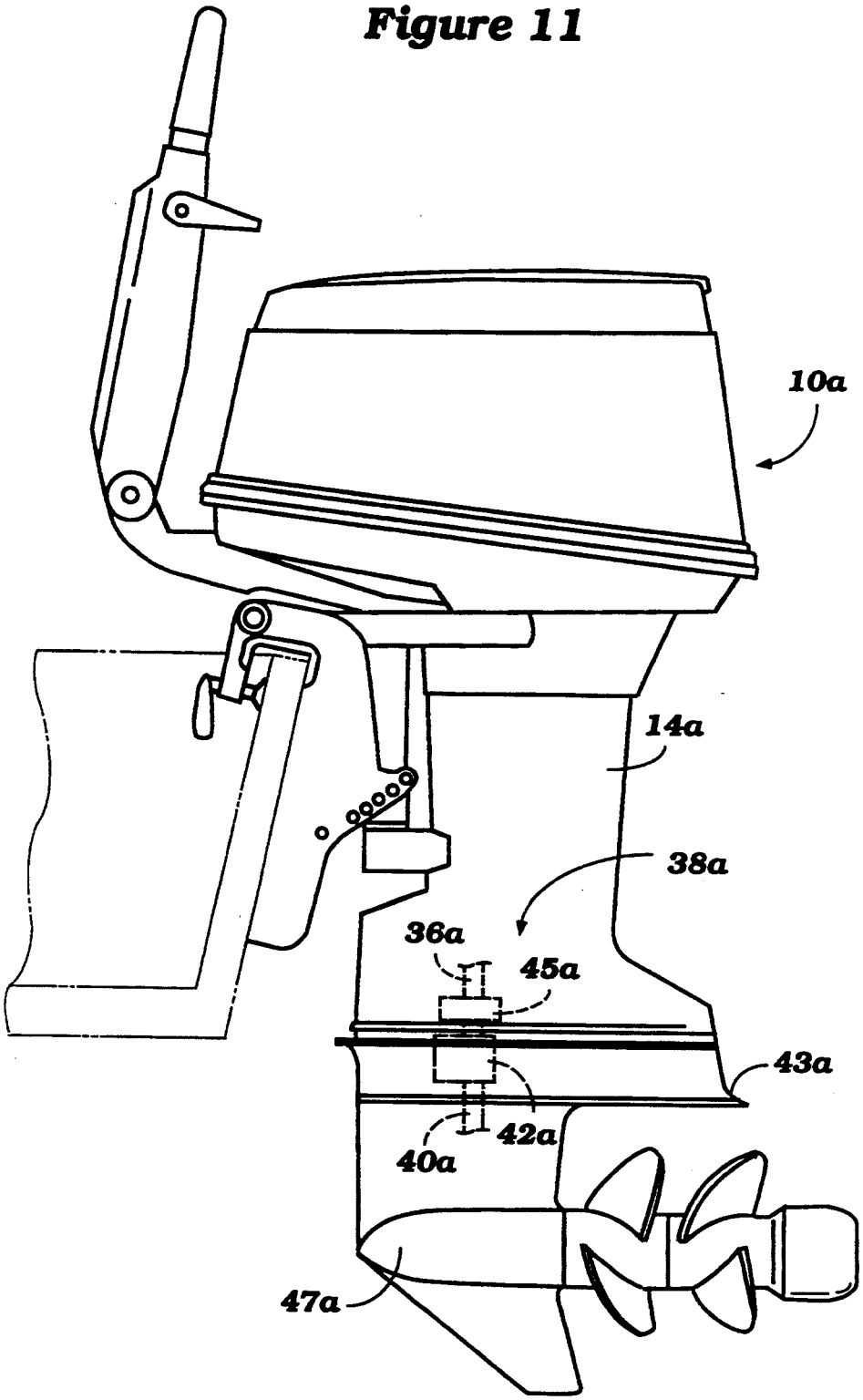
FIG. 11 is a schematic illustration of a marine outboard drive in accordance with another preferred embodiment of the present invention.

As noted above, the present invention may be used with an outboard motor as well. FIG. 11 illustrates such an embodiment. Where appropriate, like numbers with a "a" suffix have been used to indicate like parts of the two embodiments for ease of understanding. With reference to FIG. 11, the outboard motor 10*a* includes a generally vertically aligned propulsion drive train 38*a*. As with the above embodiment, it is understood that the present outboard drive 10*a* could have a propulsion drive train 38*a* skewed from the vertical axis as well. The propulsion drive train 38*a* includes a drive shaft 40*a* positioned below an input shaft 36*a*. A first transmission 42*a* selectively couples the input shaft 36*a* to the drive shaft 40*a*. The first transmission 42*a* advantageously is a forward, neutral, reverse-type transmission, configured in accordance with the above description. In this manner, the input shaft 36*a* drives the drive shaft 40*a* which rotates either in a first direction or in a second direction, as noted above.

As seen in FIG. 11, the first transmission 42*a* is advantageously located above a cavitation plate 43*a* of the outboard housing 14*a* and below a water pump 45*a* that is carried on the input shaft 36*a*. The input shaft 36*a*, like the above embodiment, always drives the water pump 45*a* in the same rotational direction and in a stabilized manner. Thus, in this arrangement, the function of the water pump 45*a* is not interrupted or otherwise impaired by gear shifting. Additionally, a lower unit 47*a* of the housing 14*a*, which is located below the cavitation plate 43*a*, is streamlined by positioning the first transmission 42*a* above the cavitation plate 43*a*. The streamline shape of the lower unit 47*a* reduces water drag across the lower unit 47*a* to improve the performance characteristics of the outboard motor 10*a*.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. An outboard drive for a watercraft comprising an output shaft rotatable driven by a motor, a rotatable upper input shaft coupled to said output shaft by an upper gearset at generally about a 90° shaft angle, a rotatable intermediate drive shaft substantially aligned with said input shaft, and a first transmission selectively coupling said drive shaft to said input shaft, said first transmission comprising a first gear attached to said input shaft, a second gear coupled to said first gear in a manner rotating said second gear in an opposite direction from that of said input shaft, and a clutch interposed between said first gear and said second gear, said clutch slidably connected to said drive shaft, said clutch being connected to a shift linkage to move said clutch between a first position, in which said clutch engages said first gear, and a second position, in which said clutch engages said second gear, said propulsion unit further comprising a lower propulsion shaft positioned generally transverse to said drive shaft and a second transmission coupling said drive shaft to said propulsion shaft, said first transmission being positioned between said upper gearset and said second transmission.

2. The outboard drive of claim 1, wherein said first transmission is positioned at or above a level of a cavitation plate of the outboard drive.

3. The outboard drive of claim 2, additionally comprising a water pump positioned on said input shaft above said first transmission.

4. The outboard drive of claim 1, wherein said first transmission is positioned above a water line of said watercraft at planing speed.

5. The outboard drive of claim 1, wherein said clutch is a friction-type clutch.

6. The outboard drive of claim 1, wherein said friction clutch comprises a dual-sided clutch cone interposed between a pair of opposing cups, one of said cups being connected to said first gear and the other of said cups being connected to said second gear.

7. The outboard drive of claim 6, wherein said shift linkage moves said clutch cone over a shaft of said clutch between said first and second positions.

8. The outboard device of claim 7, wherein said clutch shaft and said clutch cone have a spline connection, said spline having a helical shape.

9. The outboard drive of claim 1, wherein said first transmission additionally comprising a third gear which transfers rotation of said first gear to said second gear.

10. The outboard drive of claim 1, wherein said first and second gears are a pair of counter-rotating bevel gears which are in mesh with a transfer bevel gear on generally diametrically opposite sides of said transfer gear.

11. The outboard drive of claim 1, wherein said propulsion shaft is connected to at least one propeller.

12. The outboard drive of claim 1, wherein said propulsion shaft comprises an inner shaft and a hollow outer shaft generally concentrically positioned about said inner shaft, said inner shaft connected to a first propeller and said outer shaft connected to a second propeller.

13. The outboard drive of claim 12, wherein said second transmission comprises a bevel set formed by a drive bevel gear carried by said drive shaft, a front bevel gear carried by said inner shaft, and a rear bevel gear carried by said outer shaft, said drive bevel gear rotating said front bevel gear and said rear bevel gear in opposite directions so as to drive said first propeller and said second propeller in opposite directions.

14. The outboard drive of claim 1 additionally comprising a lubrication sump that surrounds said second transmission, said lubrication sump being in fluidic communication with a housing of said first transmission via influent and effluent conduits.

15. The outboard drive of claim 14, additionally comprising means for producing a flow of lubricant between said lubrication sump and said housing surrounding said first transmission.

16. The outboard device of claim 15, wherein said means increases lubricant pressure within said lubricant sump proximate to a port of said effluent conduit.

17. The outboard drive of claim 1, wherein said shift linkage comprises a clutch fork corrected to said clutch, said clutch fork adapted to move said clutch along an axis generally collinear with the axes of said input shaft and said drive shaft.

18. The outboard drive of claim 1, wherein said shift linkage couples said clutch to a rotatable shift rod, said shift linkage being adapted to convert rotational movement of said shift rod into linear movement of said clutch.

19. The outboard drive of claim 18, wherein said shift linkage has a worm connected to said shift rod and meshed with an annular worm gear such that rotational movement of said shift rod produces linear movement of said annular worm gear over said worm.

20. The outboard drive of claim 19, wherein said shift linkage additionally comprises a clutch fork connected to said clutch and coupled to said annular worm gear so as to transmit said linear movement of said annular worm gear to said clutch.

21. The outboard drive of claim 20, wherein said shift linkage further includes an arm depending from said annular worm gear and a rotatable cam member having an eccentrically positioned pin slidably connected to said arm, said cam member further having an eccentrically positioned bore which receives a portion of said clutch fork, said bore and said pin of said cam member having axes that are substantially collinear.

22. An outboard drive for a watercraft, comprising an upper output shaft, a drive train generally aligned along a vertical axis and coupled to said output shaft at generally about a 90° shaft angle, and a lower unit having propulsion shaft coupled to said drive train, said drive train being interposed between said output shaft and said lower unit, said drive train comprising a rotatable input shaft rotationally driven by said output shaft, a rotatable drive shaft positioned generally below said input shaft, and a transmission selectively coupling said drive shaft to said input shaft, said transmission including a clutch which is slidable connected to said drive shaft to move in a direction generally parallel to said vertical axis.

23. The outboard drive of claim 22, wherein said clutch is an axial friction clutch.

24. The outboard drive of claim 22, additionally comprising an outer housing which houses at least said transmission of said drive train.

25. The outboard drive of claim 24, wherein said outer housing comprises a cavitation plate, said transmission being positioned above a level of said cavitation plate.

26. The outboard drive of claim 25, additionally comprising a water pump coupled to said input shaft above said transmission.

27. The outboard drive of claim 24, wherein said outer housing defines a lubricated sump which is in fluidic communication with said transmission via influent and effluent conduits.

28. The outboard drive of claim 22, wherein said transmission is positioned above a water line of the watercraft at planning speed.

29. The outboard drive of claim 22 additionally comprising a shift linkage which interconnects said clutch to a rotatable shift rod, said shift linkage comprising means for converting rotational movement of said shift rod into linear movement of said clutch.

30. The outboard drive of claim 22, wherein said input shaft and said drive shaft are generally coaxially aligned along said vertical axis.

* * * * *